US007182534B2

(12) United States Patent
Proulx et al.

(10) Patent No.: US 7,182,534 B2
(45) Date of Patent: Feb. 27, 2007

(54) SYSTEM AND METHOD FOR INTEGRATED DYE SUBLIMATION PHOTO PRINTER PAPER TRAY

(75) Inventors: Nicole Proulx, Austin, TX (US); Kuoyong Huang, Cedar Park, TX (US); David M. Meyers, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 176 days.

(21) Appl. No.: 10/947,520

(22) Filed: Sep. 22, 2004

(65) Prior Publication Data

US 2006/0061644 A1 Mar. 23, 2006

(51) Int. Cl.
*B41J 13/10* (2006.01)
*B41J 29/00* (2006.01)
*B41J 3/36* (2006.01)

(52) U.S. Cl. ..... 400/693; 400/624; 400/88

(58) Field of Classification Search ..... None
See application file for complete search history.

(56) References Cited

U.S. PATENT DOCUMENTS 4,853,711 A * 8/1989 Piatt ..... 346/134
6,494,633 B1 12/2002 Crosby et al. ..... 400/668
2003/0016376 A1* 1/2003 Narushima ..... 358/1.13
2003/0117480 A1* 6/2003 Shiraiwa ..... 347/212

FOREIGN PATENT DOCUMENTS

JP 09254493 A * 9/1997
JP 11119496 A * 4/1999
JP 2000177856 A * 6/2000

OTHER PUBLICATIONS

Machine translation of JP 2000-177856 to Yoshida from Japanese Patent Office website.*

* cited by examiner

*Primary Examiner*—Daniel J. Colilla
(74) *Attorney, Agent, or Firm*—Hamilton & Terrile, LLP; Robert W. Holland

(57) ABSTRACT

An information handling system dye sublimation printer stores paper in an enclosed tray that couples to the printer housing and transitions between a storage configuration and a print configuration. The storage configuration reduces the footprint of the printer by aligning with the length and width of the printer housing. The print configuration aligns the tray with a print mechanism to feed paper for printing of photographic information as an image transferred by the print mechanism. In one storage configuration embodiment, the tray removeably couples to the top of the printer housing to protect the printer's operating panel. In another embodiment, the printer housing removeably couples to the bottom of the printer housing. In another embodiment, a rotationally hinged mechanism connects the printer housing and the tray to transition between the storage and print configurations with reduced risk of separation of the tray from the printer.

6 Claims, 6 Drawing Sheets

SYSTEM AND METHOD FOR INTEGRATED DYE SUBLIMATION PHOTO PRINTER PAPER TRAY

BACKGROUND OF THE INVENTION

1. Field of the Invention

The present invention relates in general to the field of information handling system printers, and more particularly to a system and method for an integrated dye sublimation photo printer paper tray.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Advances in information handling system processing and storage capabilities have resulted in frequent use of information handling systems for managing multimedia information, such as photographs and videos. In particular, the increasing availability and decreasing cost of digital cameras has made the digital camera a common household item. Quality digital photographs tend to use considerable storage so that photographers commonly rely on information handling systems as an organizational tool for maintaining photographic libraries. When a user wants a physical copy of a particular photograph, the user selects the photograph from the library and prints the photograph in the desired size. For instance, ink jet printers have evolved to have the ability to print high quality photographs from digitally-stored images. Ink jet printers spray ink in small pixels that present an overall image of the photograph. However, ink jet printers tend to have a relatively large footprint and are thus not generally a convenient mobile printing device that a user may take along with the digital camera. Portable ink jet printers are available but awkward to use and expensive with relatively low quality printing.

Recent advances in dye sublimation printing have made dye sublimation printing an increasingly popular alternative to ink jet printing for photographs. Dye sublimation printing applies heat to thin ink sheets so that the ink vaporizes from the ink sheet and reforms on printing paper. Dye sublimation printing tends to provide higher quality photographs compared with ink jet printing since dye sublimation blends pixels together at their edges while ink jet printing tends to leave separately identifiable pixels. The use of a heating element instead of inkjets allows dye sublimation printers to have smaller footprints that are more suitable to mobile use. For instance, portable dye sublimation printers are typically available to print one type of standard-sized photograph, such as 4×6 inch photographs. However, dye sublimation printers typically require a user to carry a paper tray separate from the printer that is inserted in the printer during printing. The separate paper tray tends to have a footprint that is large relative to the small size of the printer because the dye sublimation paper generally must be covered at all times to avoid getting dirt or other impurities on the paper. Impurities on dye sublimation paper have significant impact on print quality so that printer manufacturers tend to keep the paper enclosed until use in an enclosed paper tray.

SUMMARY OF THE INVENTION

Therefore a need has arisen for a system and method which integrates a dye sublimation paper tray with a dye sublimation printer for improved portability.

In accordance with the present invention, a system and method are provided which substantially reduce the disadvantages and problems associated with previous methods and systems for portable dye sublimation printers and paper trays. The paper tray couples to the printer housing in a print configuration that feeds paper to a print mechanism for printing an image on the paper. The paper tray selectively couples to the printer housing in a storage configuration that reduces the footprint of the printer compared with the print configuration to provide improved portability.

More specifically, the dye sublimation printer has plural processing components disposed in a housing that accept photographic information and transfer the information to a print media as an image using a dye sublimation printing mechanism. A print media tray contains print media in an enclosed environment and couples to the housing at the print mechanism in a print configuration to feed paper to the print mechanism. The print media tray transitions between the print configuration and a storage configuration having a smaller footprint than the print configuration. For instance, the print media tray removably couples to the bottom of the housing or, alternatively, to the top of the housing to cover and protect an operator panel. As another example, a rotationally hinged mechanism connects the housing and the print media tray to guide transitions between the storage and print configurations with reduced risk of loss of the print media tray from the printer by connection the print media tray and housing throughout transitions.

The present invention provides a number of important technical advantages. One example of an important technical advantage is that a dye sublimation paper tray integrates with a dye sublimation printer for improved portability and usability. A user carries a single integrated printing device that maintains the dye sublimation paper in an enclosed environment until use and that transforms quickly and intuitively from the portable configuration to a printing configuration and back. In embodiments having the printer tray coupled to the printer, the user is less likely to misplace the paper tray and the complete device is more secure and sturdy, reducing the risk of damage from mishandling or dropping when separate pieces are assembled for use or taken apart for storage.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

A portable information handling system dye sublimation printer integrates a paper tray that keeps the paper in an enclosed container in a storage configuration and transitions the paper tray to a print configuration for printing images communicated from the information handling system. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
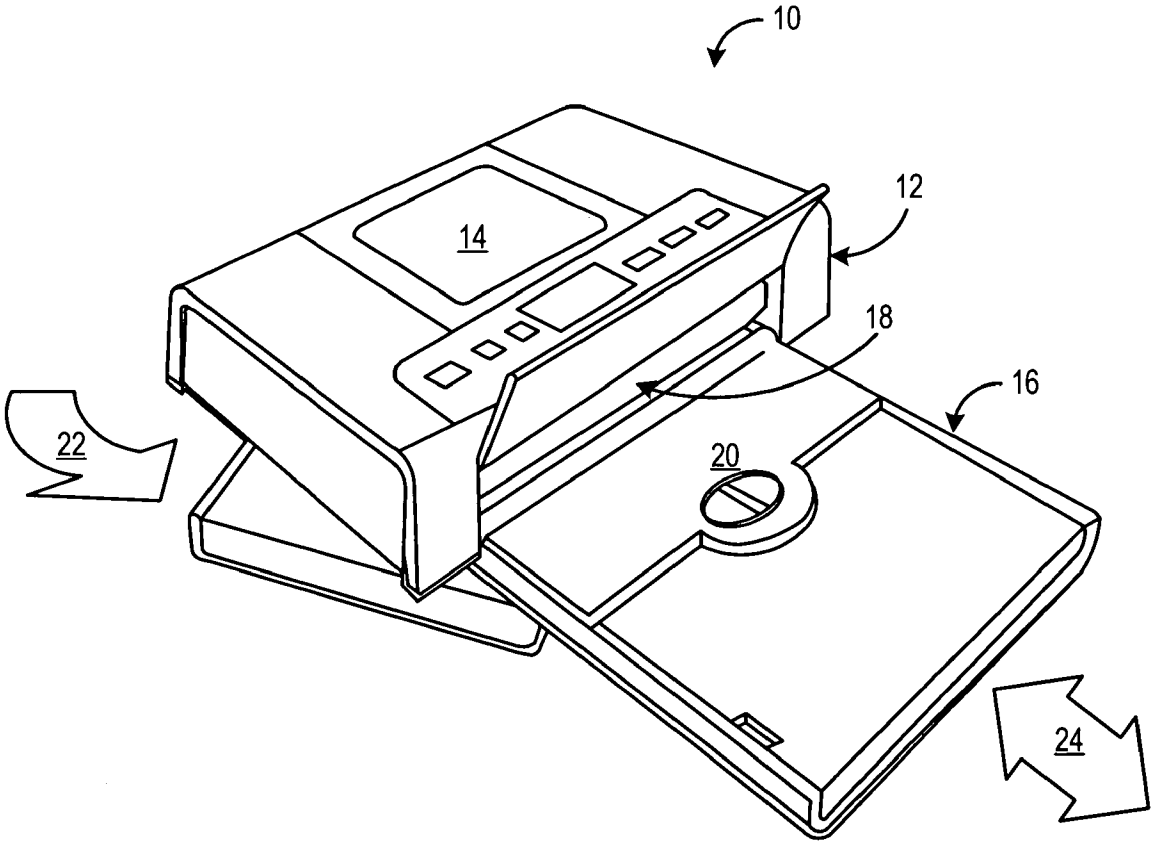
FIG. 1 depicts one embodiment of a dye sublimation printer having a rotationally hinged paper tray.

Referring now to FIG. 1, a top perspective view of a dye sublimation printer 10 depicts a transition from a storage configuration to a print configuration. Dye sublimation printer 10 has an outer housing 12 that contains processing components to process photographic information received from an information handling system and a dye sublimation print mechanism for transferring the photographic information to print media as an image. An operator panel 14 disposed at the top of housing 12 accepts user inputs to control print functions. Print media, such as photographic paper, is fed from a print media tray 16 to a print mechanism 18 located within housing 12. Print media tray 16 maintains an enclosed environment to reduce the introduction of contaminants to the print media. Print media tray 16 connects to housing 12 with a rotationally hinged mechanism 20 that rotates print media tray 16 between a storage configuration at the bottom of housing 12 and a print configuration having an operational coupling with print mechanism 18, as depicted by arrow 22. In the storage configuration, print media tray 16 aligns its length and width with the length and width of housing 12 to have a minimal footprint. In the print configuration, the footprint of printer 10 increases due to the insertion of print media tray 16 along its width into print mechanism 18 at a print axis 24 along the length of housing 12. Print media tray 16 opens or detaches to accept inputs of new paper in the print orientation.

Figure 2:
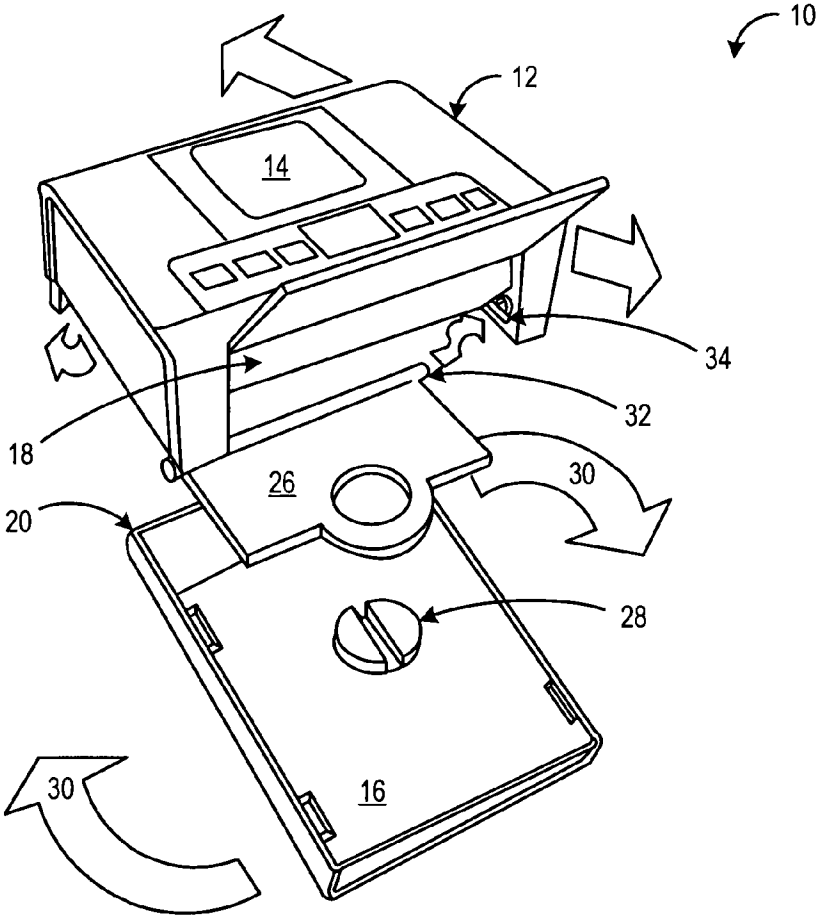
FIG. 2 depicts a blown-up view of the rotationally hinged paper tray.

Referring now to FIG. 2, a blown-up view of dye sublimation printer 10 depicts rotationally hinged mechanism 20 in greater detail. A hinged flap 26 rests over tray 16 and has an opening aligned with a securing pin 28 connected to tray 16. Securing pin 28 rotationally couples to tray 16 as depicted by arrows 30 to align tray 16 for insertion in print mechanism 18 or for storage at the bottom of housing 12. Hinged flap 26 has opposing pins 32 that engage pin guides 34. Pin guides 34 guide tray 16 to a position proximate printing mechanism 18 by guiding pins 32 out from under the bottom of housing 12 and upwards to an insertion position for print mechanism 18. Alternatively, pin guides 34 guide tray 16 to a release point having an opening to allow decoupling of tray 16 from housing 12. Maintaining a continuous connection between tray 16 and housing 12 reduces the risk of inadvertent separation resulting in the loss of tray 16. Allowing separation of tray 16 from housing 12 allows the user greater flexibility and helps avoid breakage of pins 32 from application of excessive force when inserting tray 16 into print mechanism 18.

Figure 3A:
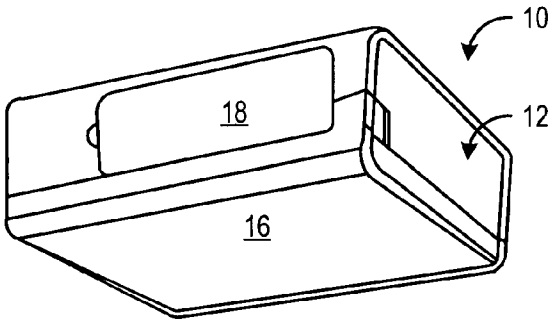
FIGS. 3A, 3B, 3C and 3D depict one embodiment of a dye sublimation printer having a paper tray removeably coupled to the bottom of the printer housing.
Figure 3B:
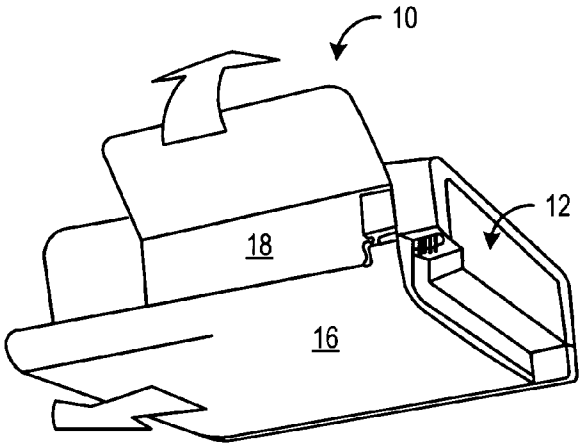
Figure 3C:
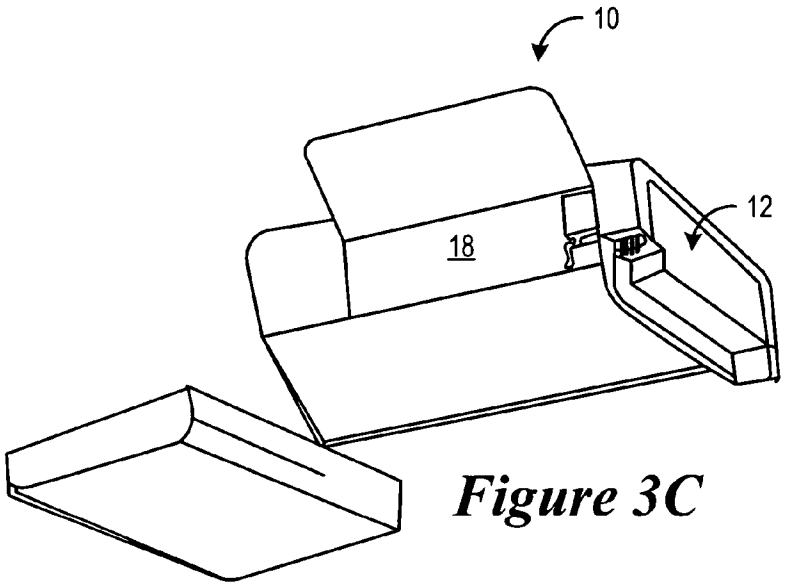
Figure 3D:
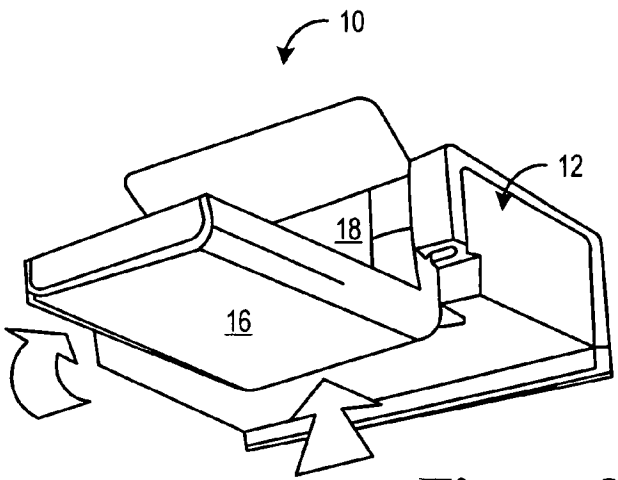
Figure 4:
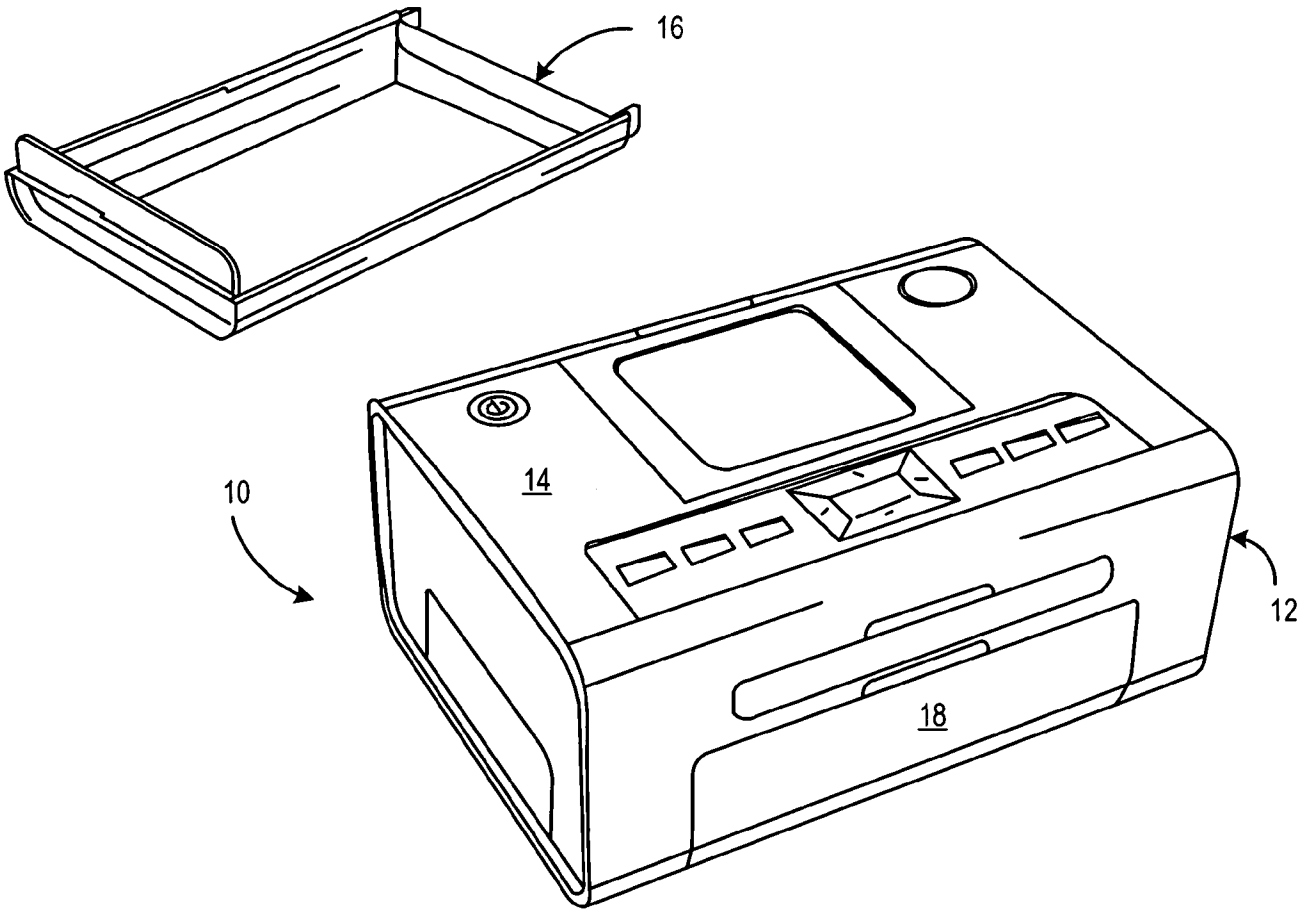
FIG. 4 depicts one embodiment of a dye sublimation printer having a paper tray removeably coupled to the top of the printer housing.

Referring now to FIGS. 3A, 3B, 3C and 3D, an alternative embodiment is depicted in which print tray 16 is removeably coupled to housing 12 of dye sublimation printer 10. FIG. 3A depicts tray 16 coupled to housing 12 to form a contiguous unit in a storage configuration having ease of portability and a relatively small footprint. FIG. 3B depicts decoupling of tray 16 from housing 12 by opening print mechanism 18 and releasing tray 16. For instance, tray 16 couples to housing 12 with a connector having a form factor similar to the connector of print mechanism 18. Thus connection and release of tray 16 to housing 12 is similar to connection and release of tray 16 to print mechanism 18 for ease of user adaptability. FIG. 3C shows tray 16 separate from housing 12 during the transition between the storage and print orientations, such as for loading paper in tray 16. As depicted by FIG. 3D, tray 16 decouples from housing 12 for a user to align tray 16 in a print configuration for printing information on paper in tray 16. Tray 16 remains enclosed against contaminants in both the storage and print configurations. An alternative embodiment depicted by FIG. 4 removeably couples tray 16 to the top of housing 12 so that, in addition to providing a convenient storage configuration, protection is provided to operator panel 14 in the storage configuration.

Figure 5A:
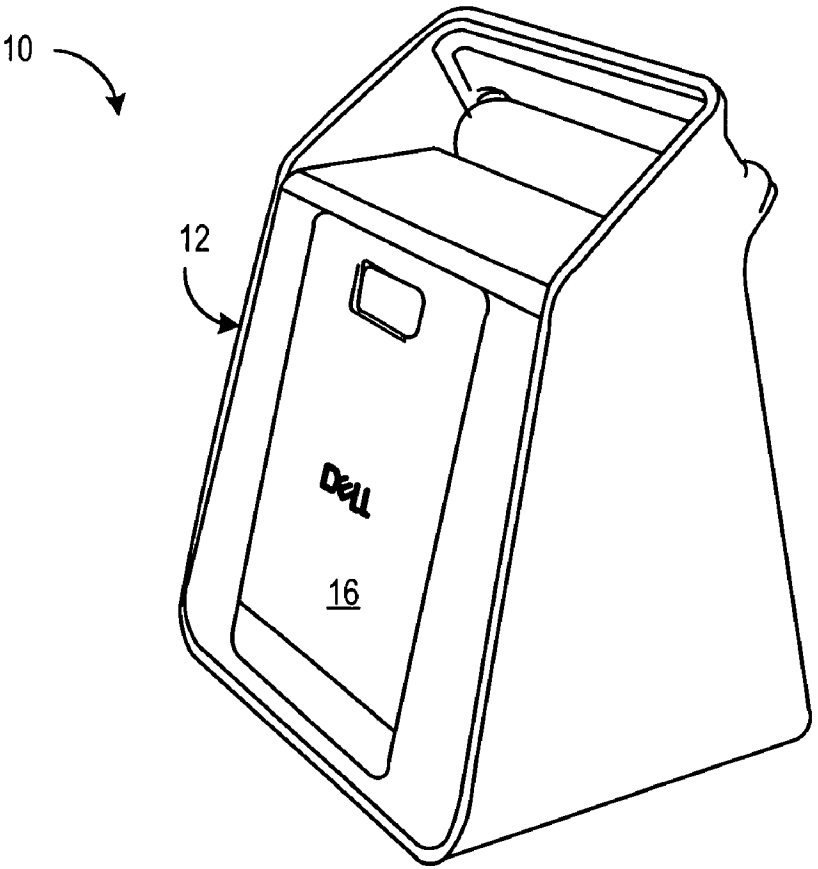
FIGS. 5A and 5B depict one embodiment of a dye sublimation printer having a vertically oriented storage orientation and a horizontally oriented print orientation.
Figure 5B:
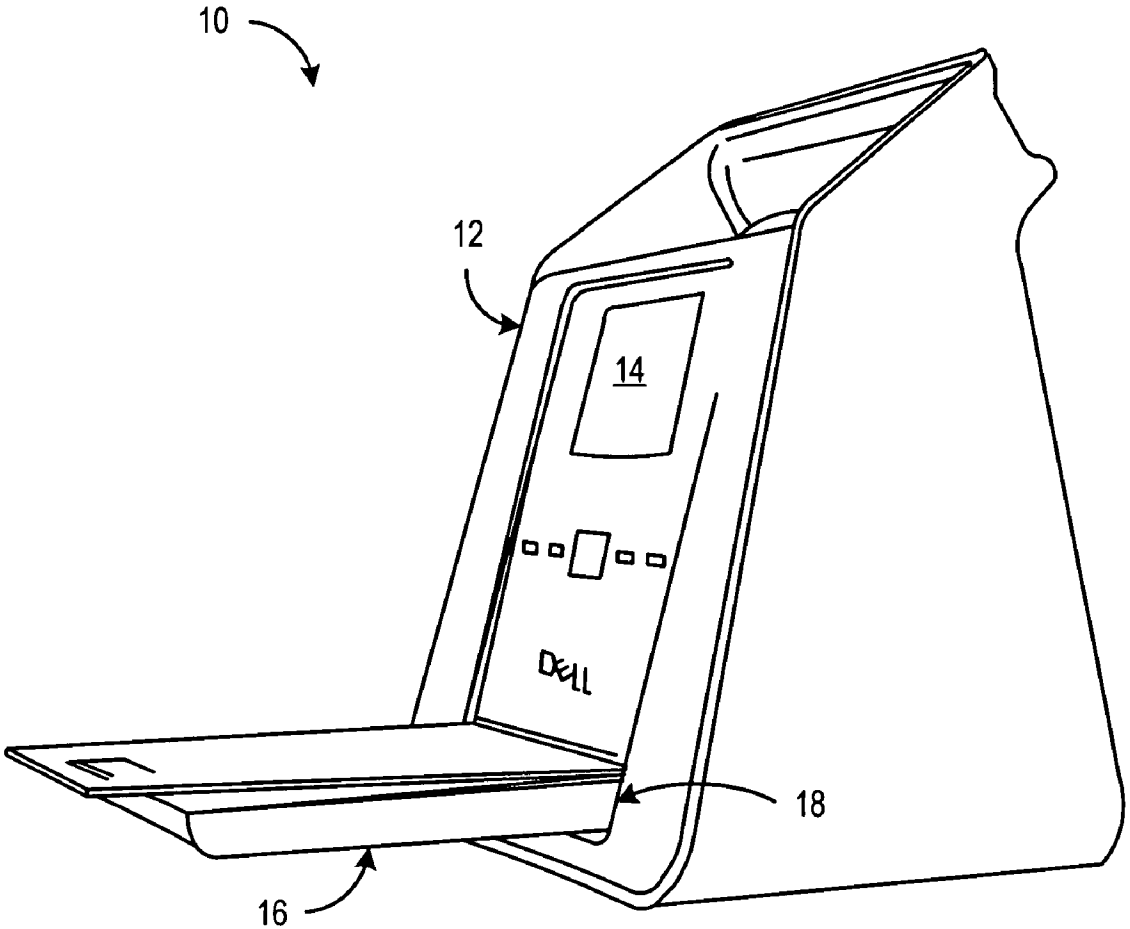

Referring now to FIGS. 5A and 5B, another alternative embodiment is depicted in which print tray 16 is removeably coupled to housing 12 of dye sublimation printer 10. FIG. 3A depicts tray 16 coupled to housing 12 to form a contiguous unit in a storage configuration having ease of portability and a relatively small footprint. Tray 16 aligns in a vertical storage orientation that covers the operator panel of printer 10. FIG. 3B depicts decoupling of tray 16 from housing 12 by releasing tray 16 to rotate to a horizontal print orientation and insert into print mechanism 18. Tray 16 remains enclosed against contaminants in both the storage and print configurations. Rotation from the storage orientation to the print orientation exposed operator panel 14 and allows the lid of tray 16 to lift for insertion of additional paper.

Although the present invention has been described in detail, it should be understood that various changes, substitutions and alterations can be made hereto without departing from the spirit and scope of the invention as defined by the appended claims.

What is claimed is:

1. A method for printing information on a print media, the method comprising:

enclosing the print media in a tray;

coupling the tray to a printer housing aligned in a storage configuration, the storage configuration having a footprint substantially equal to the length by the width of the printer housing;

decoupling the tray from the printer housing;

aligning the tray in a print configuration proximate a print media feed mechanism the print configuration having a footprint substantially equal to the length of the printer housing by the length of the tray;

coupling the tray to the print media feed mechanism; and printing information to print media taken from the tray in the print configuration.

2. The method of claim 1 further comprising:

completing the printing of information; and returning the tray from the print configuration to the storage configuration.

3. The method of claim 1 wherein the printer is a dye sublimation printer.

4. The method of claim 1 wherein coupling the tray further comprises coupling the tray to the bottom of the printer housing.

5. The method of claim 1 wherein coupling the tray further comprises coupling the tray to the top of the printer housing.

6. The method of claim 5 wherein coupling the tray to the top of the printer housing further comprises covering an operator panel disposed at the top of the printer housing.

* * * * *